US011758978B2

(12) United States Patent
Bazan et al.

(10) Patent No.: US 11,758,978 B2
(45) Date of Patent: Sep. 19, 2023

(54) ARTICLE OF FOOTWEAR WITH REMOVABLY SECURED MECHANICAL CUSHIONING

(71) Applicant: NIKE, Inc., Beaverton, OR (US)

(72) Inventors: MariaRosa Bazan, Treviso (IT); Mauro Bianchin, Treviso (IT); Sergio Cavaliere, Venice (IT); John Cross, Portland, OR (US); Laura De Faveri, Treviso (IT); Roberto De Marchi, Treviso (IT); Korado Kapaj, Treviso (IT); Ryan R. Larson, Portland, OR (US); Daniela Paggin, Treviso (IT)

(73) Assignee: NIKE, Inc., Beaverton, OR (US)

( * ) Notice: Subject to any disclaimer, the term of this patent is extended or adjusted under 35 U.S.C. 154(b) by 85 days.

(21) Appl. No.: 17/479,497

(22) Filed: Sep. 20, 2021

(65) Prior Publication Data

US 2022/0104584 A1 Apr. 7, 2022

Related U.S. Application Data

(60) Provisional application No. 63/088,656, filed on Oct. 7, 2020.

(51) Int. Cl.

| | |
|---|---|
| ***A43B 13/36*** | (2006.01) |
| ***A43B 3/24*** | (2006.01) |
| ***A43B 13/18*** | (2006.01) |
| ***A43B 13/30*** | (2006.01) |

(52) U.S. Cl.

CPC ..... *A43B 13/36* (2013.01); *A43B 3/244* (2013.01); *A43B 3/246* (2013.01); *A43B 13/181* (2013.01); *A43B 13/30* (2013.01)

(58) Field of Classification Search

CPC ..... A43B 13/36; A43B 13/18; A43B 13/181; A43B 13/183; A43B 13/30; A43B 3/244; A43B 3/246

USPC ..... 36/15, 101

See application file for complete search history.

(56) References Cited

U.S. PATENT DOCUMENTS

| | | | | | |
|---|---|---|---|---|---|
| 180,276 | A | * | 7/1876 | Rogers | A43B 13/08 36/15 |
| 631,821 | A | * | 8/1899 | Riemer | A43B 13/08 36/15 |
| 1,184,702 | A | * | 5/1916 | Staubach et al. | A43B 13/36 36/15 |
| 2,651,117 | A | * | 9/1953 | Harris | A63H 3/52 36/15 |
| 3,890,725 | A | * | 6/1975 | Lea | A43B 3/244 36/11.5 |
| 4,317,294 | A | * | 3/1982 | Goodyear | A43B 13/36 36/36 B |
| 4,420,894 | A | | 12/1983 | Glassman | |

(Continued)

FOREIGN PATENT DOCUMENTS

| | | | |
|---|---|---|---|
| KR | 200437192 | Y1 | 11/2007 |
| WO | 2020079714 | A1 | 4/2020 |

*Primary Examiner* — Marie D Bays
(74) *Attorney, Agent, or Firm* — Quinn IP Law

(57) ABSTRACT

An article of footwear includes an upper having an internal volume adapted to receive a foot of a wearer and a sole structure secured to the upper. The sole structure includes a chassis plate provided within the upper, a midsole secured to the chassis plate such that the upper extends between the chassis plate and the midsole, and an outsole tread element attached to a ground facing surface of the midsole.

17 Claims, 7 Drawing Sheets

(56) References Cited

U.S. PATENT DOCUMENTS

| | | | | |
|---|---|---|---|---|
| 5,701,686 | A * | 12/1997 | Herr | A43B 13/203 36/7.8 |
| 6,389,712 | B1 * | 5/2002 | Schelling | A43B 13/122 36/31 |
| 7,874,083 | B1 * | 1/2011 | Tillman | A43B 13/26 36/73 |
| 10,588,379 | B2 | 3/2020 | Sussmann | |
| 2002/0174569 | A1 * | 11/2002 | Tsai | A43B 3/103 36/11.5 |
| 2003/0230007 | A1 * | 12/2003 | Walton | A43B 13/36 36/15 |
| 2005/0108897 | A1 * | 5/2005 | Aveni | A43B 13/187 36/27 |
| 2011/0138652 | A1 * | 6/2011 | Lucas | A43B 13/14 36/28 |
| 2012/0246969 | A1 * | 10/2012 | Baum | A43B 13/181 36/27 |
| 2014/0068966 | A1 * | 3/2014 | Chaffin | A43B 13/183 36/28 |
| 2015/0027000 | A1 * | 1/2015 | Barnes | A43B 13/183 36/87 |
| 2015/0089834 | A1 * | 4/2015 | Baum | A43B 13/181 36/27 |
| 2019/0104805 | A1 * | 4/2019 | Del Biondi | A43B 13/125 |
| 2019/0125028 | A1 * | 5/2019 | Bartel | A43B 5/185 |
| 2020/0113275 | A1 * | 4/2020 | Zuborev | A43B 3/246 |
| 2021/0368918 | A1 * | 12/2021 | Lyke | A43B 13/20 |

* cited by examiner

ARTICLE OF FOOTWEAR WITH REMOVABLY SECURED MECHANICAL CUSHIONING

CROSS REFERENCE TO RELATED APPLICATIONS

The present application claims the benefit of priority from U.S. Provisional Patent Application No. 63/088,656, filed 7 Oct. 2020, which is incorporated by reference in its entirety.

TECHNICAL FIELD

The present disclosure relates to an article of footwear that includes a removably secured midsole with mechanical cushioning elements.

BACKGROUND

Conventional articles of athletic footwear include two primary elements, an upper and a sole structure. The upper provides a covering for the foot that securely receives and positions the foot with respect to the sole structure. In addition, the upper may have a configuration that protects the foot and provides ventilation, thereby cooling the foot and removing perspiration. The sole structure is secured to a lower surface of the upper and is generally positioned between the foot and the ground. In addition to attenuating ground reaction forces and absorbing energy (i.e., imparting cushioning), the sole structure may provide traction and control potentially harmful foot motion, such as over pronation. Accordingly, the upper and the sole structure operate cooperatively to provide a comfortable structure that is suited for a wide variety of ambulatory activities, such as walking and running.

Conventional sole structures can generally incorporate multiple layers that are typically referred to as an insole, a midsole, and an outsole. The insole is a thin, cushioning member located within the upper and adjacent the plantar (lower) surface of the foot to enhance footwear comfort. The midsole, which is traditionally attached to the upper along the entire length of the upper, forms the middle layer of the sole structure and serves a variety of purposes that include controlling foot motions and providing cushioning. The outsole forms the ground-contacting element of footwear and is usually fashioned from a durable, wear-resistant material that includes texturing to improve traction.

Conventional midsoles are often formed from a resilient, polymer foam material, such as polyurethane or ethylvinylacetate, that extends throughout the length of the footwear. The properties of the polymer foam material in the midsole are primarily dependent upon factors that include the dimensional configuration of the midsole and the specific characteristics of the material selected for the polymer foam, including the density of the polymer foam material. By varying these factors throughout the midsole, the relative stiffness, degree of ground reaction force attenuation, and energy absorption properties may be altered to meet the specific demands of the activity for which the footwear is intended to be used.

DETAILED DESCRIPTION

The following discussion and accompanying figures disclose an article of footwear 10 (also referred to as the article 10) that includes a removable sole structure with a mechanical cushioning element (as opposed to primarily relying on foam). These designs may enable any major component of the shoe to be selectively replaced, thus extending the total life of the article. Further, enabling easy removal of the components may permit an end user to customize colorways according to their own preferences, or to achieve a particular look. In some configurations, it may be preferable to form some or all of the components out of a thermoplastic polymer or other easily recyclable material to promote a sustainable design and minimize manufacturing and/or post-consumer waste. The concepts disclosed herein may be applied to a wide range of footwear styles and should not limited to the specific embodiments discussed below and depicted in the figures.

In addition to easy component replacement, the present designs may enable new/different retail models or practices that may be more autonomous, reduce overall packaging waste, enable a greater degree of user customization, and/or reduce supply chain complexity. For example, in one configuration, one or more components of an article of footwear may be formed using a 3D printing/rapid on-demand production technique, and may be made in a custom color and size for a particular user. This would reduce the need for separate packaging, inventorying, and global distribution of that components. Likewise, in some embodiments, individual components may be offered for sale from a vending machine or other automated purchase device. Such a vending machine may be placed at a traditional retail establishment for self-service walk-up commerce, or may be placed at an event venue and stocked with limited edition color or design components to commemorate that event. Other applications of the present technology are listed below.

Figure 1:
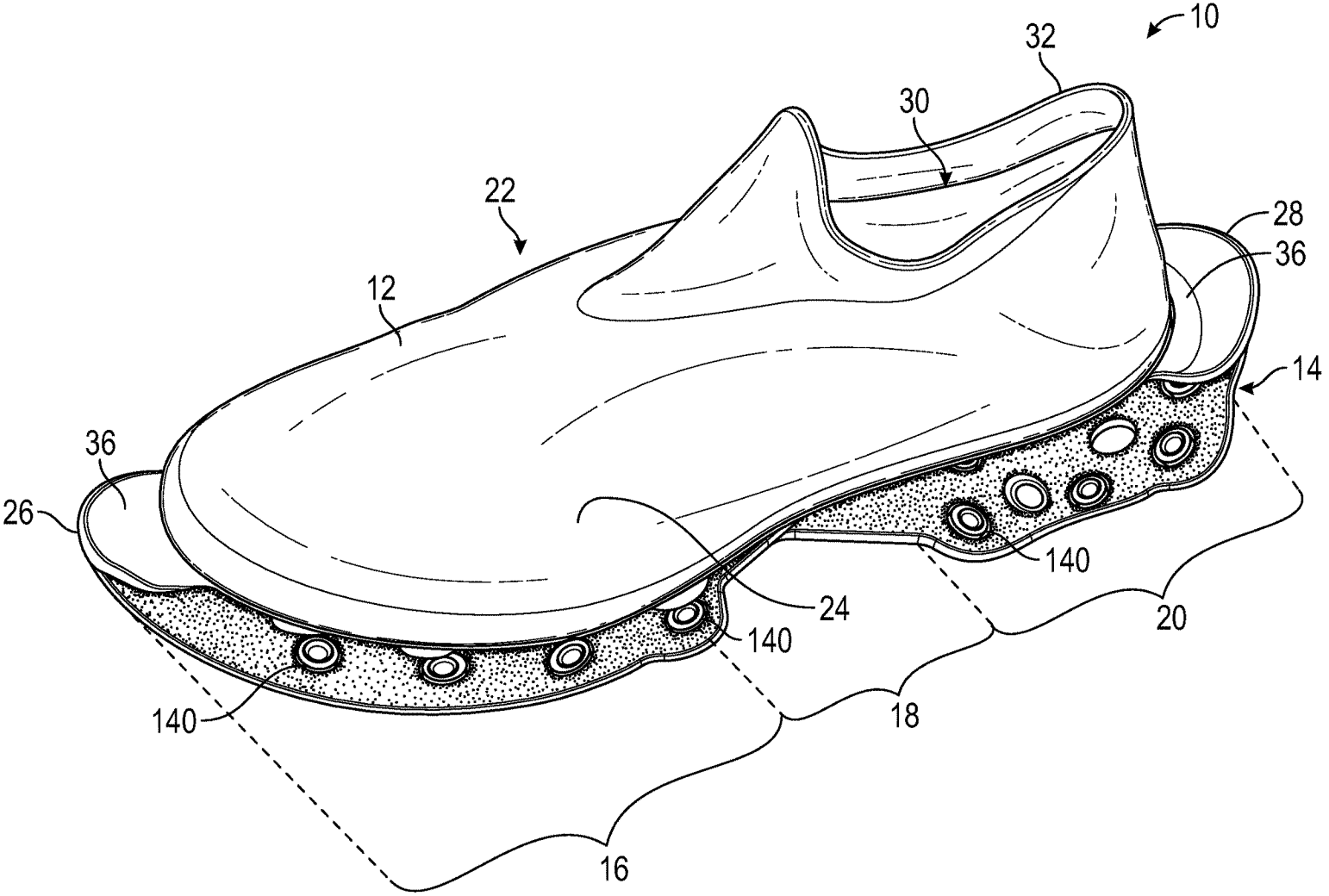
FIG. 1 is a schematic upper side perspective view of an article of footwear with removably secured mechanical cushioning.

With reference to FIG. 1, an article of footwear 10 is depicted that includes an upper 12 and a sole structure 14 attached to the upper 12. The article of footwear 10 may be divided into one or more regions. The regions may include a forefoot region 16, a midfoot region 18, and a heel region 20. The forefoot region 16 may correspond with toes and joints connecting metatarsal bones with phalanx bones of a foot. The midfoot region 18 may correspond with an arch area of the foot while the heel region 18 may correspond with rear portions of the foot, including a calcaneus bone.

The article of footwear 10 may additionally include a medial side 22 and a lateral side 24 that correspond with opposite sides of the article of footwear 10 and extend through the regions 16, 18, 20. The article of footwear 10 may generally extend between an anterior end 26 or anterior end portion, which may correspond to the most forward point of the forefoot region 16, and a posterior end 28 or posterior end portion, which may correspond to the most rearward point of the heel region 20. A longitudinal axis of the article of footwear may be defined as extending between the anterior end 26 and the posterior end 28. As used herein, anatomical directional references such as anterior and posterior should be understood as referencing directions of the article of footwear that would be consistent with the ends 26, 28 defined above and with established anatomical convention when the shoe is worn on the foot of a wearer.

The upper 12 includes interior surfaces that defines an interior void 30 that receives and secures a foot for support on the sole structure 14. An ankle opening 32 in the heel region 20 may provide access to the interior void 30. For example, the ankle opening 32 may receive a foot to secure the foot within the void 30 and facilitate entry and removal of the foot from and to the interior void 30.

In some examples, one or more fasteners or other closure systems may extend across the upper 12 to adjust a fit of the interior void 30 around the foot while concurrently accommodating entry and removal of the foot therefrom. The fasteners or other closure systems may include laces, straps, cords, latching mechanisms, clasps, snaps, hook-and-loop, or any other suitable type of fastener.

The upper 12 may be formed from one or more materials that are stitched or adhesively bonded together to form the interior void 30. Suitable materials of the upper 12 may include, textiles, foam, leather, and synthetic leather. In one embodiment, the upper 12 may be formed from a knit fabric to provide a more sock-like feel than traditional rigid uppers. The materials may be selected and located to impart properties of durability, air-permeability, wear-resistance, flexibility, and comfort to the foot while disposed within the interior void 30.

The sole structure 14 is attached to an underside of the upper 12 and provides the article of footwear 10 with support and cushioning during use. Namely, the sole structure 14 attenuates ground reaction forces caused by the article of footwear 10 striking the ground during use. Accordingly, and as set forth below, the sole structure 14 may incorporate energy absorbing design characteristics to allow the sole structure 14 to minimize the impact experienced by a user when wearing the article of footwear 10.

Figure 2:
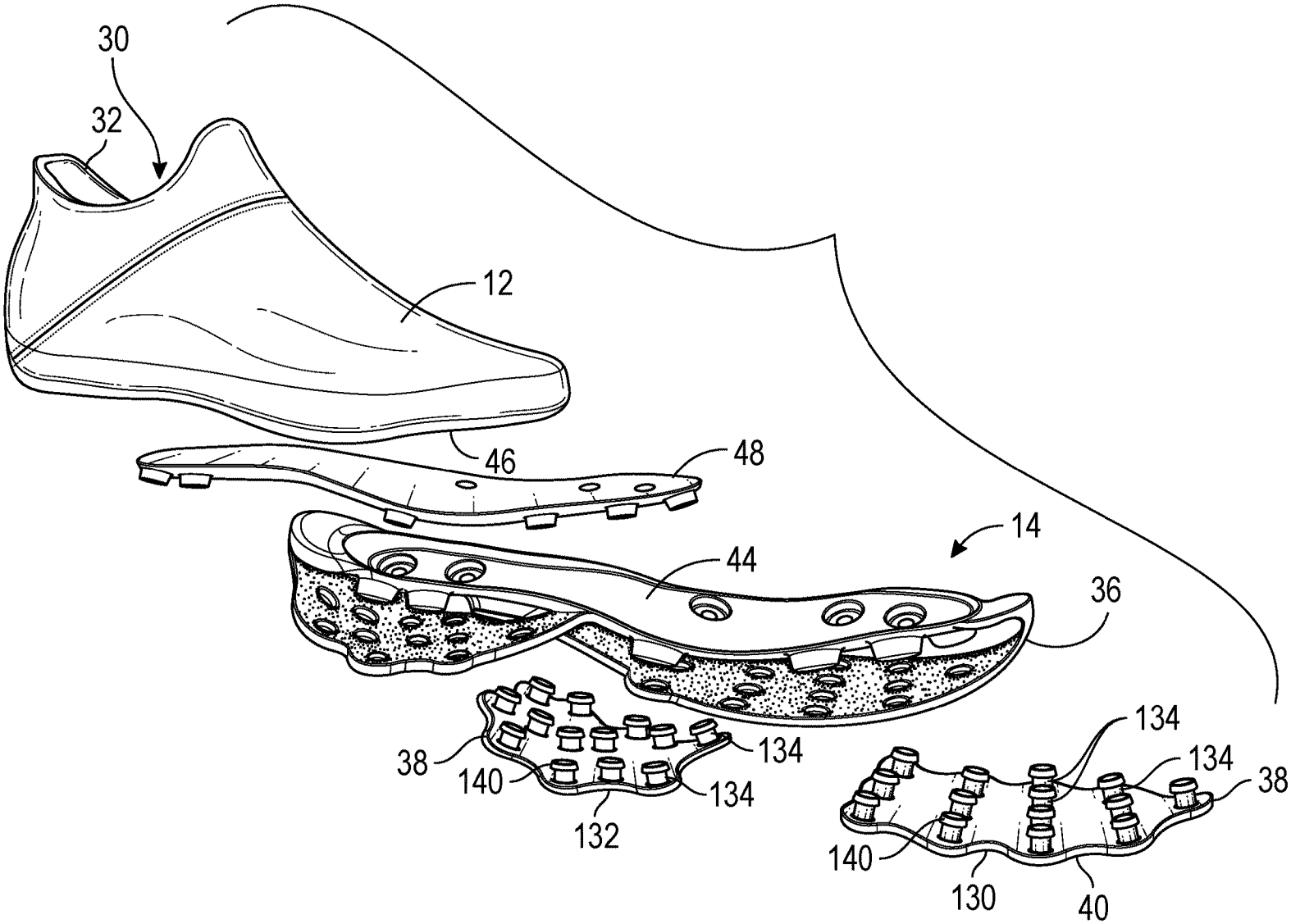
FIG. 2 is a schematic exploded view of the article of footwear of FIG. 1.
Figure 3:
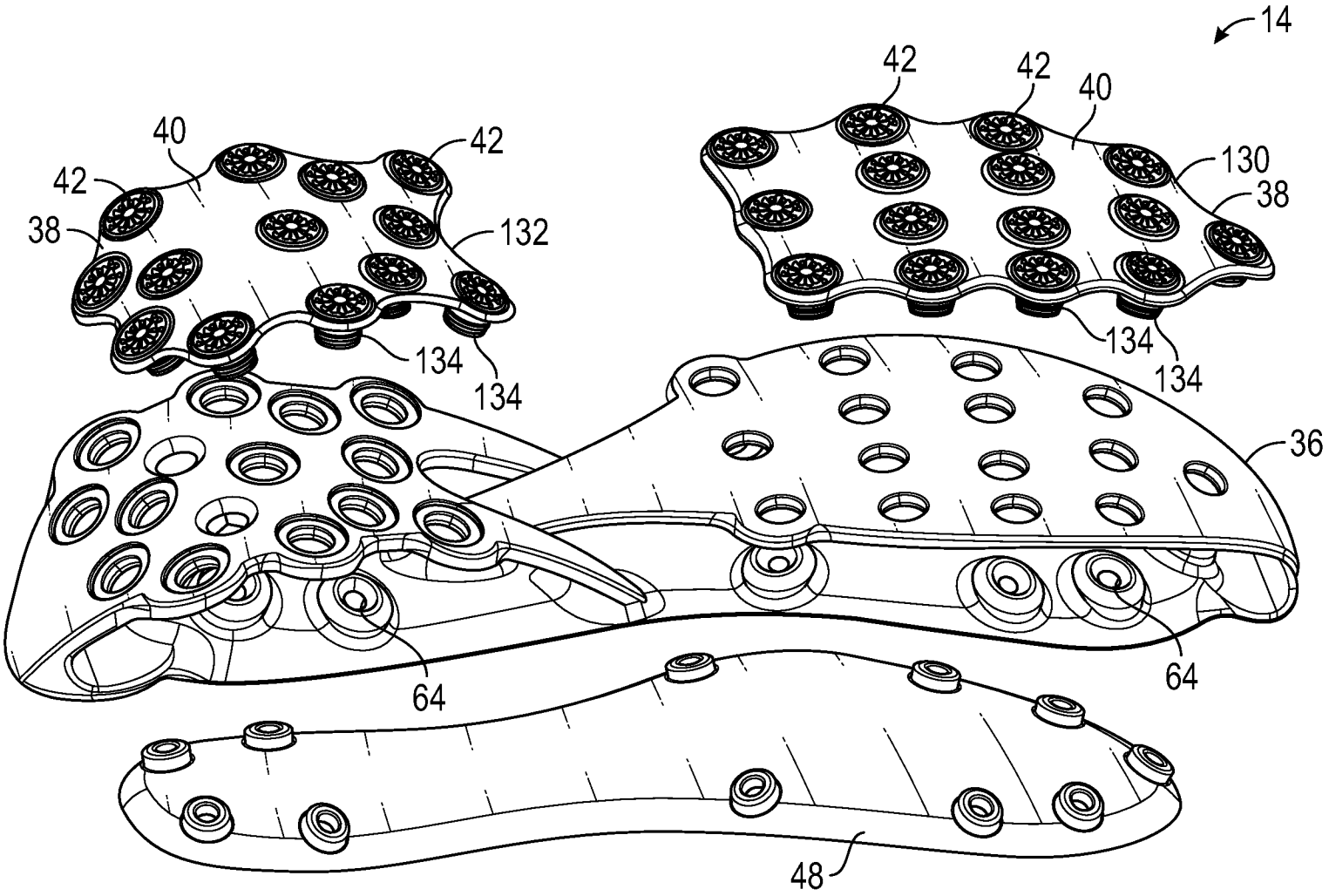
FIG. 3 is a schematic exploded vice of a sole structure for an article of footwear.

Referring to FIGS. 2-3, in general, the sole structure 14 may include a midsole 36 and an outsole 38 (or one or more outsole members or inserts). As generally illustrated in FIG. 1, the midsole 36 may extend from the anterior end 26 to the proximal end 28 of the article of footwear and may further extend beyond the anterior and proximal extremes of the upper 12. Such an overextension may, for example, provide a suitable foothold to aid the wearer in removing the shoe. The midsole 36 is secured to a lower portion of upper 12 and is positioned such that it extends under the foot during bipedal use. Among other purposes, midsole 36 is designed to attenuate ground reaction forces and to absorb energy (i.e., impart cushioning) when the user is walking or running.

With continued reference to FIGS. 2-3 an outsole 38 or plurality of outsole members are provided on a lower, ground-facing surface of the midsole 36, and on an opposite side of the midsole 36 from the upper 12. The outsole 38 may define a ground-engaging surface 40 that is operative to provide wear-resistance and to enhance traction between the article of footwear 12 and the ground. The outsole 38 may be formed from a resilient material such as, for example, a rubber or durable thermoplastic polyurethane, which can improve traction and durability. The ground-engaging surface 40 may include one or more traction elements 42 (as best illustrated in FIG. 3) or protrusions that extend outward to provide the article of footwear 10 with increased traction during use.

When fully assembled, an upper surface 44 of the midsole 36 may contact and be secured against a lower, ground-facing portion 46 of the upper 12. In one configuration, the upper surface 44 of the midsole may be attached to the upper 12 using a suitable adhesive that may establish a permanent bond between the two components. In a different configuration, however, the midsole 36 may be secured to the upper 12 by securing it to a mating sole component that is integrated into the ground-facing portion 46 of the upper 12. For example, as shown in FIG. 2, the sole structure 14 may further include a chassis plate 48 that is either slipped in the inner void 30 to rest against the lower surface of the upper (similar to an insole or drop-in midsole) or that is directly integrated into the upper 12, similar to a strobel. It is worth noting that the order of the components in the exploded view of FIG. 2 is shown for illustrative convenience, and that the chassis plate 48 is a drop-in component that is slipped into or wholly integrated with the upper 12.

Figure 4:
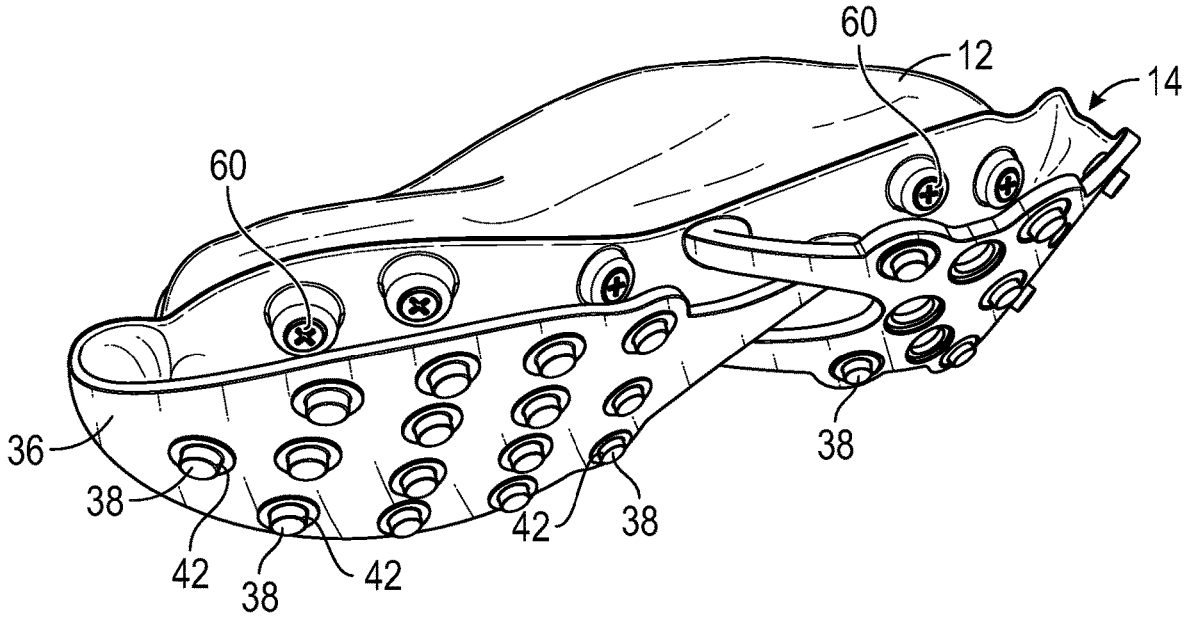
FIG. 4 is a schematic bottom side perspective view of an article of footwear with removably secured mechanical cushioning.

While FIGS. 2 and 3 schematically illustrate outsole portions 38 that are comparatively large and include a plurality of traction elements, in the embodiment schematically illustrated in FIG. 4, the outsole 38 may instead include a plurality of discrete outsole portions 38, with each outsole portion comprising a single traction element 42.

In some configurations, the midsole 36 may be secured to the chassis plate 48 by direct attachment either through welding (e.g., fusing two thermoplastic polymers together without an intermediate adhesive) or adhering with the use of an intermediate adhesive between the components. In another configuration, such as shown in FIG. 4, the sole structure 14 may include a plurality of threaded fasteners 60 that extend between and operatively secure the midsole 36 in a fixed position relative to the chassis plate 48. By un-securing these fasteners 60, the midsole 36 may be removable from both the chassis plate 48 and the upper 12 to facilitate easy repair or replacement of one or more components of the article of footwear 10. While threaded fasteners are shown and described herein for securing the midsole 326 to the chassis plate 48, in other embodiments, other types of fasteners may be used. For example, push-in fasteners, quarter turn locking fasteners, or other forms of removable fastening may be used.

Figure 5:
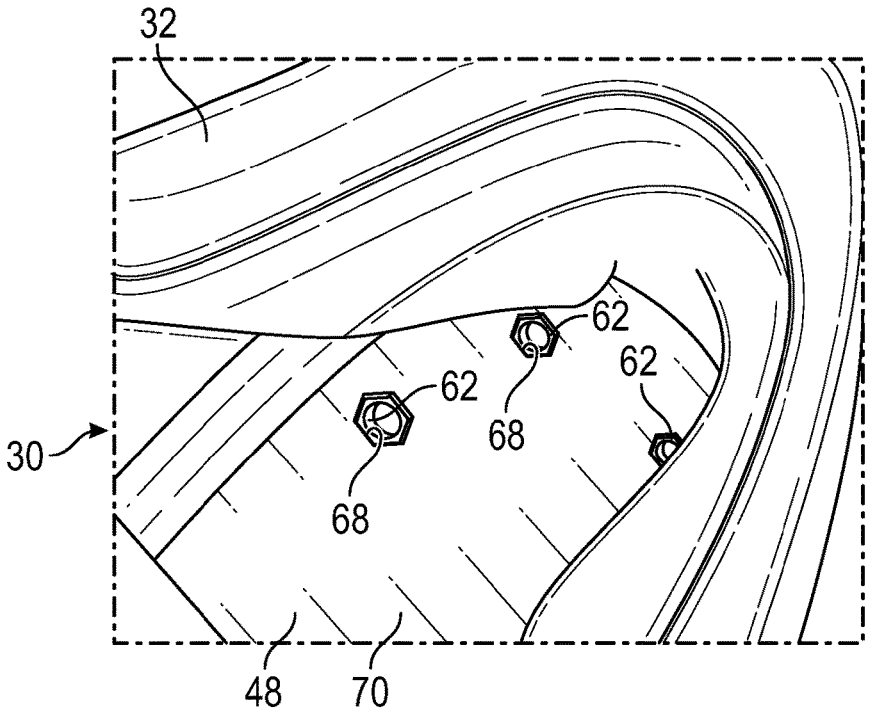
FIG. 5 is a schematic top perspective view of the article of footwear of FIG. 4, looking into the shoe through the ankle opening

As shown in FIG. 5, in one embodiment, the chassis plate 48 may include a plurality of threaded anchors 62 that are each adapted to receive a different one of the plurality of threaded fasteners 60. When assembled, each threaded fastener 60 may extend through a corresponding aperture 64 provided in the midsole 36 and may be threadably engaged with a different one of the plurality of threaded anchors 62 to secure the midsole 36 to the chassis plate 48. The plurality of threaded anchors 62 may include, for example, tapped/threaded apertures formed directly into the chassis plate 48, threaded bushings that are press fit or otherwise secured within apertures in the chassis plate 48, or, as shown in FIG. 5 hex nuts that are seated within a corresponding hexagonal aperture 68 in an upper surface 70 of the chassis plate 48.

In some configurations, once assembled, the material of the upper 12 may extend at least partially between the chassis plate 48 and the upper surface 44 of the midsole 36. The chassis plate 48 and the midsole 36 may exert a compressive force against the trapped material of the upper 12, which may provide sufficient resistance to prevent and/or inhibit the upper from decoupling from the midsole 36/sole structure 14. In one configuration, the upper 12 may further include one or more reinforced eyelets or grommets on the ground-facing portion 36, through which the threaded fasteners may pass when secured to the chassis plate. These eyelets/grommets may further aid in stabilizing the upper 12 relative to the sole structure 14.

Figure 6:
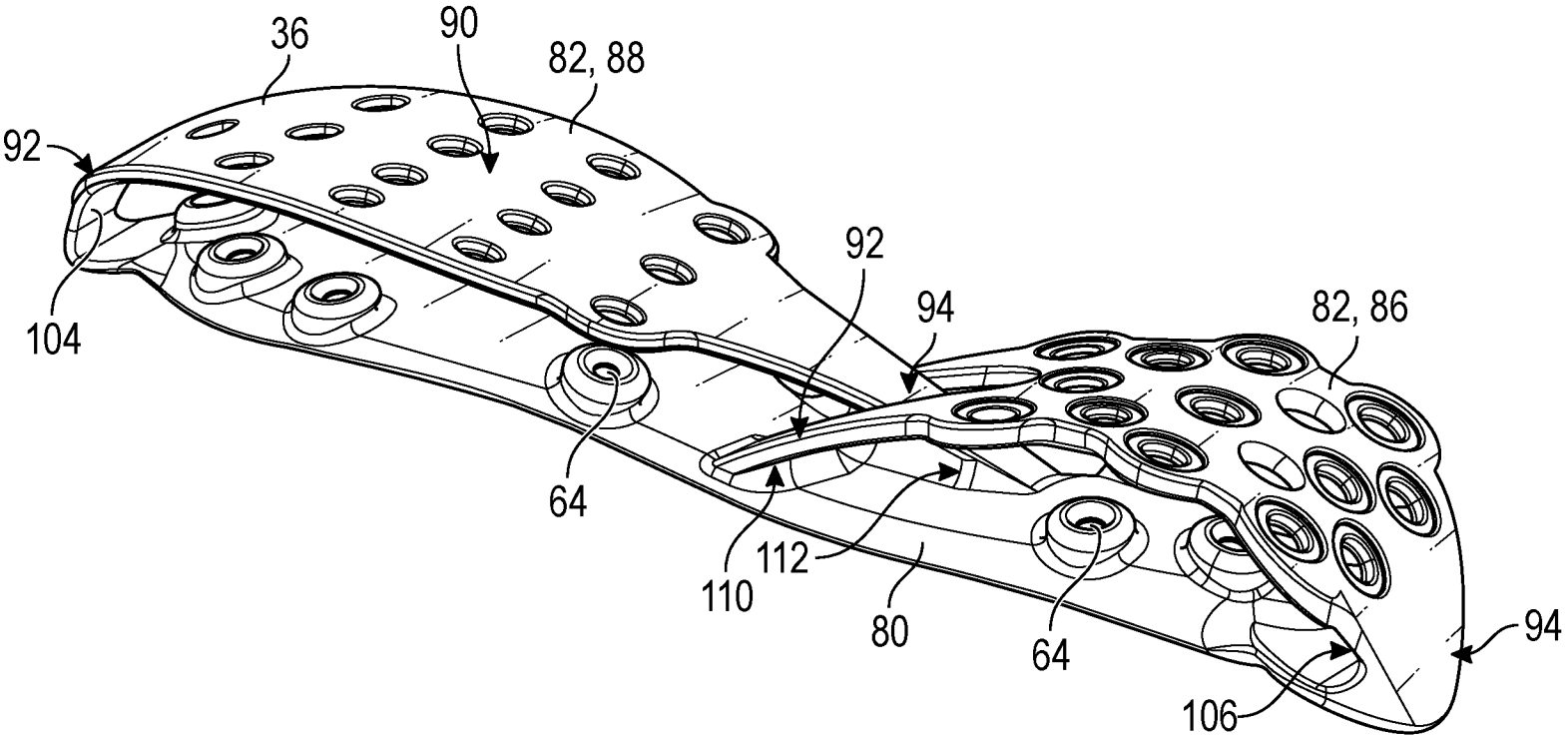
FIG. 6 is a schematic side perspective view of a midsole structure such as may be used with the article of footwear of FIG. 1.
Figure 7:
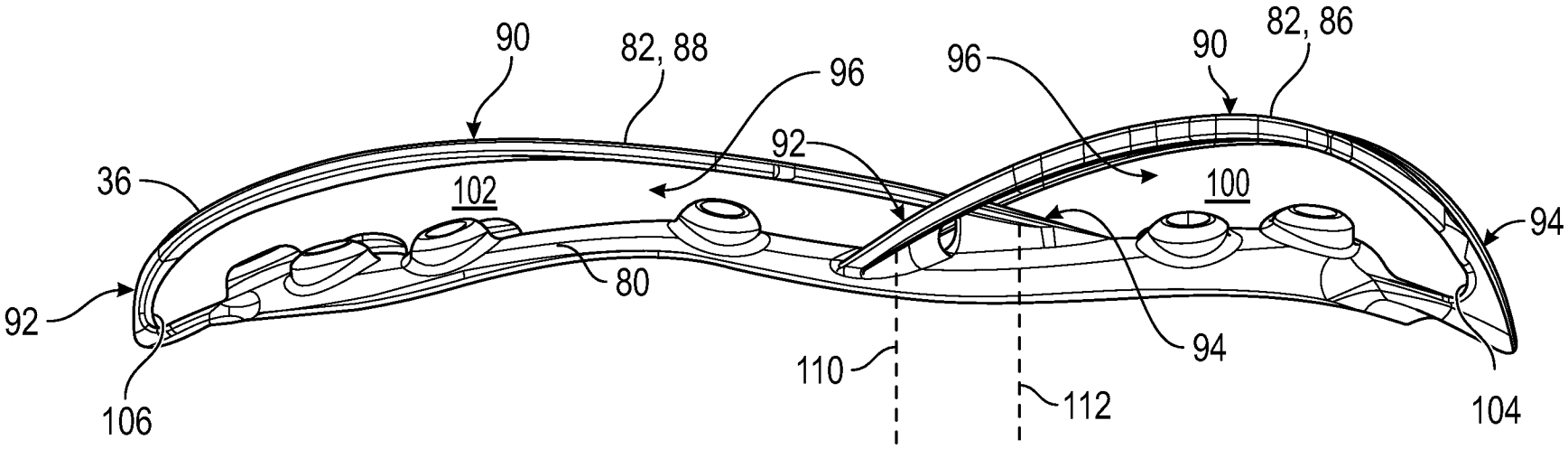
FIG. 7 is a schematic side view of the midsole structure of FIG. 6.

Referring to FIGS. 6-7, in some embodiments, the article of footwear 10 may at least partially rely on the structural design of the midsole 36 to attenuate ground reaction forces during use. This structural design generally relies on the midsole 36 flexing on impact and rebounding as the forces dissipate. The midsole 36 may include an upper plate 80 that is integrally coupled with one or more ground-facing lower plates 82 to form one or more spring-like shock absorbers. As generally discussed above, the upper plate 80 may extend across the entire length of the upper 12 from at least the anterior end 26 to the posterior end 28. Further, the upper plate 80 may define the plurality of apertures 64 through which the threaded fasteners 60 may pass to secure the midsole 36 to the upper 12.

The one or more ground facing lower plates 82 may each have a length, measured parallel to the longitudinal axis that is less than a similarly measured length of the upper plate 80. Said another way, each ground facing lower plate 82 may extend under only a portion of the upper plate 80. As generally illustrated in FIGS. 6-7, in one configuration, the midsole 36 may include a first ground facing lower plate 86 that is substantially located within the heel region 20 and a second lower plate 88 that is substantially located within the forefoot region 16.

Each ground facing lower plate 86, 88 may have a respective central portion 90, anterior end portion 92, and posterior end portion 94, with the central portion 90 being located between the anterior end portion 92 and the posterior end portion 94. At least one of the anterior or posterior end portion 92, 94 of each lower plate 86, 88 may be secured to or otherwise joined to the upper plate 80, while the central portion 90 may be spaced apart from the upper plate 80. In some configurations, the midsole 36 may define a void 96 or open space between one or both of the lower plates 86, 88 and the upper plate 80. This void 96 may enable the respective lower plate 86, 88 to more easily yield in response to an impact loading. As better shown in FIG. 5, in one configuration, a first void 100 may extend between the central portion 90 of the first lower plate 86 and the upper plate 80 and may extend through the midsole 80 from the lateral side to the medial side. Further, in some configurations, a second void 102 may extend between the central portion 90 of the second lower plate 88 and the upper plate 80 and may similarly extend through the midsole 36 from the lateral side to the medial side.

As further illustrated, in one configuration, the first ground-facing lower plate 86, provided in the heel region 20, may be joined to the upper plate 80 via a first radiused transition 104 that is provided at a posterior end of the midsole 36. Likewise, the second ground-facing lower plate 88, provided in the forefoot region 16, may be joined to the upper plate 80 via a second radiused transition 106 that is provided at an anterior end of the midsole 36. In doing so, the midsole 36 may have an appearance where the upper plate 80 wraps downward at both the posterior and anterior ends to form the respective first and second lower plates 86, 88. In doing so, this design leaves the sidewalls substantially open to provide the respective voids 96, 102 through the width of the midsole 36. In this configuration, the upper plate 80, first lower plate 86 and second lower plate 88 may all be integrally formed, such as through an injection molding, 3d printing/additive manufacturing process, or thermoforming process.

In a general sense, the present design may attenuate ground impact forces by enabling the respective lower plates 86, 88 to elastically deform in response to an applied load. As shown in the figures, in one configuration, each lower plate may operate similar to a leaf spring—i.e., where each lower plate 86, 88 is anchored at opposing anterior and posterior end portions 92, 94, and the central portion 90 is operative to deflect toward the upper plate 80 in response to an applied transverse load. In this embodiment, such as shown in FIGS. 6-7, both the anterior and posterior end portions 92, 94 of each lower plate 86, 88 may be integrally formed with the upper plate 80. This may be accomplished, for example, using one or more molding processes, including injection molding, compression molding, and the like. Likewise, in some embodiments, this may be accomplished through a 3d printing/additive manufacturing process.

Greater travel distances in the lower plate 86, 88, and thus greater cushioning/force attenuation, may be provided by spacing the respective anterior and posterior end portions 92, 94 for each lower plate 86, 88 further apart. In one configuration, a midsole 36 with adequate cushioning performance may be provided though a design where the anterior end portion 92 of the first, heel-side lower plate 86 attaches to the upper plate 80 or otherwise terminates at a first location 110 that is anterior to a second location 112 where the posterior end portion 94 of the second, forefoot lower plate 88 attaches to the upper 12 or otherwise terminates. As shown in FIG. 6, in one embodiment of this design, the midsole 36 may have a scissored appearance, where one of the two plates attaches in a central location between the medial and lateral sides 22, 24, and the other plate extends on opposing sides of that plate and attaches at locations that are more peripherally located. In another embodiment, one plate may attach closer to the medial side 22 of the upper plate 80, while the other plate may attach closer to the lateral side 24.

As noted above and generally illustrated in FIGS. 4-5, the midsole 36 may be removably secured to the chassis plate 48 and upper 12 using a plurality of threaded fasteners 60 that each extend through a different respective hole/aperture 64 provided in the upper plate 80. In one embodiment, to provide access to these threaded fasteners, one or more of the lower plates 82 may include a plurality of access apertures 120 extending entirely through the thickness of the lower plate 82, with each access aperture 120 being aligned with a different one of the plurality of apertures 64 in the upper plate 80. The access apertures 120 may facilitate tightening of the respective threaded fasteners 60 by allowing an elongate tool, such as a screwdriver, to extend through the access aperture 120 into contact with the fastener 60.

Figure 8:
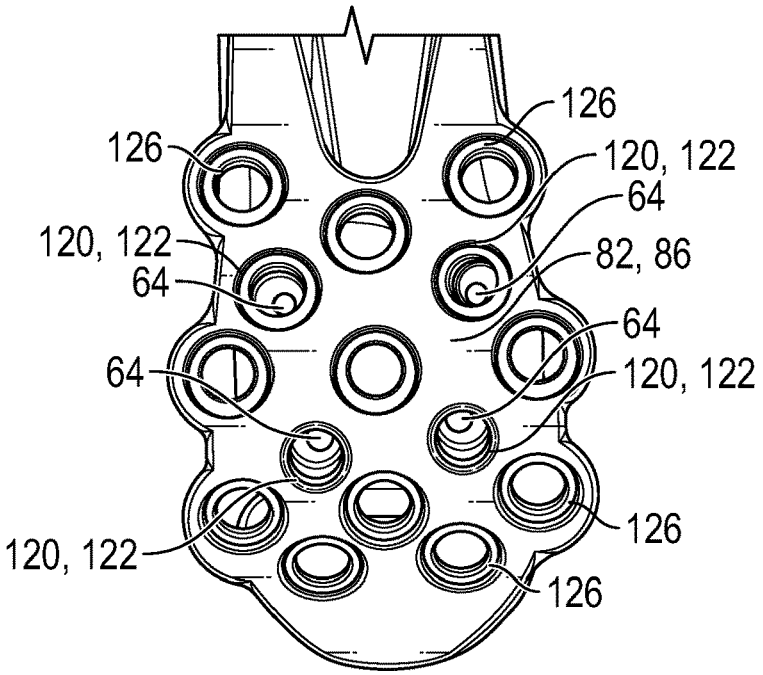
FIG. 8 is a schematic bottom perspective view of a heel portion of the midsole structure of FIG. 6
Figure 9:
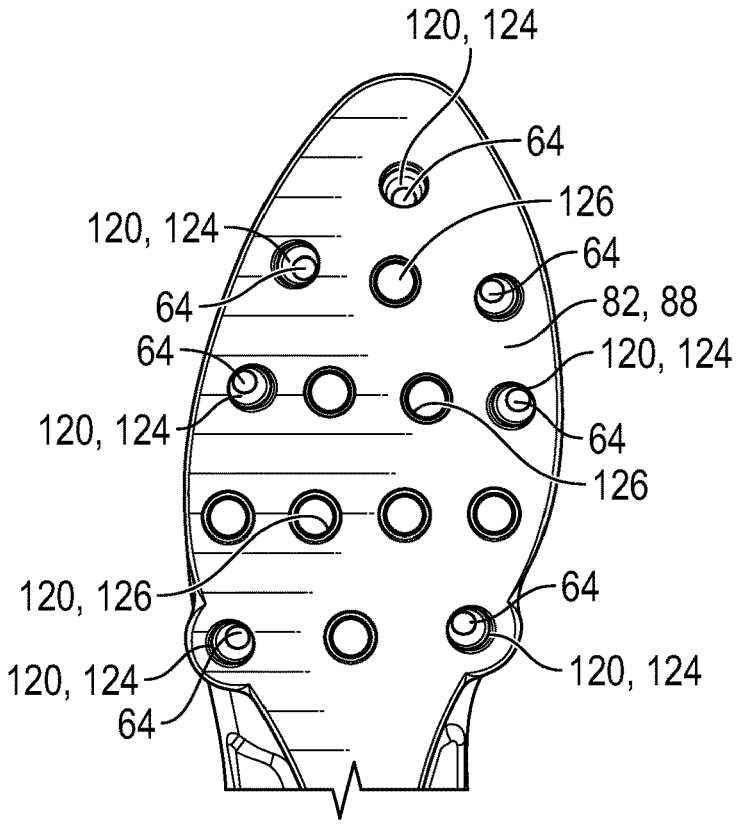
FIG. 9 is a schematic bottom perspective view of a forefoot portion of the midsole structure of FIG. 6

FIGS. 8-9 schematically illustrate the alignment between each of the plurality of apertures 64 in the upper plate 80 and the plurality of access apertures 120 in the respective lower plates 82. In general, the term "aligned" in the context of the alignment of holes between the two plates, is intended to mean that each aperture is centered around a longitudinal axis of a threaded fastener as that threaded fastener is being threaded into the chassis plate 48 through the aperture 64 in the upper plate 80.

In some embodiments, the midsole 36 may be secured to the chassis plate 48 in both the heel region 20 and in the forefoot region 16. As such, the first lower plate 86 comprises a first plurality of access apertures 122, while the second lower plate 88 includes a second plurality of access apertures 124. As shown in FIG. 8, the first plurality of access apertures 122 in the first lower plate 86 are aligned with a first subset of the plurality of apertures 64 in the upper plate 80. Likewise, as shown in FIG. 9, the second plurality of access apertures 124 in the second lower plate 88 are aligned with a second subset of the plurality of apertures 64 in the upper plate 80. As further illustrated in FIGS. 8-9, the number of access apertures 120 provided in the midsole 36 may be less than the total number of apertures provided in the one or more lower plates 82. More specifically, the midsole 36 may further include one or more ancillary apertures 126 that extend entirely through the lower plate 82, though are not aligned with a corresponding aperture 64 in the upper plate 80. In one embodiment, the total number of ancillary apertures 126 may be greater than the total number of access apertures 120.

Referring again to FIGS. 2-3, rather than simply leaving the access apertures 120 and/or ancillary apertures 126 open, these apertures may instead be used to retain or secure the outsole 38 to the midsole 36. For example, in one configuration, the outsole 38 may include a forefoot outsole portion 130 and a heel outsole portion 132, such as shown in FIG. 2. In this configuration, each of the forefoot outsole portion 130 and heel outsole portion 132 may include a plurality of posts 134 that extend upward into the plurality of access apertures 120 in the lower plate 82. These posts 134 may be glued in place, however in a more preferable embodiment, they may simply be press fit into the holes. In one embodiment, each post 134 may include a retention feature 140 (as best seen in FIGS. 1 and 2) that protrudes to an opposing side of the lower plate 80 and has a diameter that is larger than a corresponding diameter of the aperture through which it extends. In this manner, the retention feature 140 may provide a mechanical interference that resists the post 134 from easily being removed from the aperture.

In the embodiment shown in FIG. 4, where discrete outsole elements are used, each of the plurality of discrete outsole elements may at least partially extend into a different one of the plurality of apertures in the lower plate. For example, each discrete outsole element may include a respective post that may be press fit, adhered, or otherwise secured within a respective aperture). Similar to the embodiment shown in FIG. 2, each post may include a retention feature, much like the design shown in FIG. 2.

In general, the outsole described above is configured to be removable from the midsole to provide selective access to the threaded fasteners and enable a user to separate the midsole from the upper. In one configuration, the process of disassembling a fully assembled article of footwear 10 may begin by removing the outsole 38 and/or the plurality of outsole members from the apertures in the lower plate. Opening these apertures, by removing the outsole 38, may then permit a tool, such as a screwdriver, hex wrench, socket driver, or the like to be inserted through the various apertures to individually engage each threaded fastener 60. By rotating the tool, each threaded fastener may be removed, which may decouple the midsole from the upper.

Once apart, further disassembly of the article of footwear may be achieved, for example, by removing a sock liner or insole from the interior void of the upper. Likewise, in some configurations, the chassis plate 48 may also be removed from the interior void 30 of the upper 12. Full disassembly in this manner may permit each component to be individually replaced should that component begin to show signs of wear from use.

Given the ease with which the present article of footwear 10 may be disassembled and individual components may be replaced, it would be preferable for each component to be capable of being recycled or reused in some manner to advance the goal of sustainable manufacturing/product design. As such, in one configuration, at least the midsole 36 and the chassis plate 48 may be substantially formed from a thermoplastic polymer that may be easily melted down and recycled. The term "substantially" is intended to contemplate that certain aperture bushings or threaded hex nuts may be formed from metal, while the main body of the component may be formed entirely from the thermoplastic polymer. Furthermore, in some designs, the outsole 38 may also be formed from a thermoplastic polymer, and likewise, in some designs the upper 12 may comprise a knit material formed from a yarn that includes a thermoplastic polymer. In some embodiments, the yarn used to form the knit upper may be entirely formed from thermoplastic polymer filament. In one configuration, each of the upper 12, the chassis plate 48, the midsole 36 and the outsole 38 may be substantially formed from a thermoplastic polymer material (i.e., with the exception of any threaded fasteners, retention members, or bushings used to facilitate the joining of the various components). In this manner, the present article of footwear 10 may be entirely recyclable while also maintaining the ability to selectively replace one or more components that are exhibiting signs of wear.

In one configuration, each of the midsole 36 and chassis plate 48 may be formed from a non-foamed polymer material or, alternatively, from a composite material containing fibers such as carbon fibers. Suitable materials may include thermoplastic polyurethane (TPU), polyamides (e.g., PA6 or PA66), or other engineering polymers. The material may include a fiber fill, such as short or long fiber glass, aramid, bamboo, or carbon fibers, or may include similar continuous fabrics. Forming the midsole 36 from a relatively rigid material allows the midsole 36 to distribute forces associated with use of the article 10 while also preventing the structure from collapsing on itself under the weight of the wearer. In one configuration, to prevent debris from becoming trapped within the intermediate recess/void 96 between the upper and lower plates 80, 82, a foamed thermoplastic polymer material may be provided between the plates. To facilitate access to the threaded fasteners 60, the foamed thermoplastic polymer material may include through-hole apertures extending between the access apertures 120 in the lower plate 82 and the apertures 64 in the upper plate 80.

An example of an upper construction that may be used with the present article of footwear 10 is described in U.S. Patent Application Pub. No 2017/0311672 (the '672 application), which was filed on 20 Jul. 2017, and is hereby incorporated by reference in its entirety. The '672 application generally describes a knitted upper that has a multilayer fabric construction that resembles a sock or "bootie." As described, the upper may further have selective reinforcement or stiffening portions within the heel, lateral sidewall, and/or medial sidewall. These stiffened portions may be provided, for example, by incorporating thermoplastic stiffening panels between adjacent knitted layers, or by thermally treating regionally provided thermoplastic yarns within the knit to alter a material property of the fabric.

The upper 12 may be constructed by pulling one or more layers of tubular knit material onto a last, and then closing a toe seam, for example, using RF or ultrasonic welding techniques. In one configuration, the tubular knit material may include a plurality of thermoplastic fibers. Likewise, in some embodiments, the upper may include other features typical of a shoe, such as lace eyelets graphical embellishments, and the like. Further detail on the process for forming a strobel-less upper are explained in the '672 application mentioned above. While a strobel-less upper is preferred, in other embodiments, the upper 12 may be constructed in a standard manner by seaming a vamp and/or other shoe portions to a strobel.

In one embodiment, a business model suitable to commercialize the present design may include offering at least one of the components for sale separate from the remaining components. Such may be accomplished through the use of self-service vending machines, or through traditional retail means. This may permit users to customize and/or repair their article of footwear by replacing only a single component. In yet another embodiment, global supply chain systems may be greatly simplified by producing one or more of the shoe components local to the final point of sale. For example, the midsole 36 may be produced using an additive manufacturing process, such as fused filament fabrication at a retail site, or at a regional distribution/manufacturing center that is within a predefined local distance of the retail site. Such a model would not only simplify global supply chain logistics, but may also reduce the need for excess inventory production and storage by producing components as requested (i.e., directly by the consumer, or requested by a retailer when inventory is getting low). It may also permit a greater degree of user customization in terms of the colors, embellishments, fit, and/or cushioning/support properties.

The above features and advantages, and other features and advantages, of the present teachings are readily apparent from this detailed description of some of the best modes and other embodiments for carrying out the present teachings, as defined in the appended claims, when taken in connection with the accompanying drawings.

"A," "an," "the," "at least one," and "one or more" are used interchangeably to indicate that at least one of the item is present; a plurality of such items may be present unless the context clearly indicates otherwise. All numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; about or reasonably close to the value; nearly). If the imprecision provided by "about" is not otherwise understood in the art with this ordinary meaning, then "about" as used herein indicates at least variations that may arise from ordinary methods of measuring and using such parameters. In addition, disclosure of ranges includes disclosure of all values and further divided ranges within the entire range. Each value within a range and the endpoints of a range are hereby all disclosed as separate embodiment. The terms "comprises," "comprising," "including," and "having," are inclusive and therefore specify the presence of stated items, but do not preclude the presence of other items. As used in this specification, the term "or" includes any and all combinations of one or more of the listed items. When the terms first, second, third, etc. are used to differentiate various items from each other, these designations are merely for convenience and do not limit the items.

Any directional references used herein presume that the article of footwear is positioned in an upright posture on a flat, horizontal ground plane, such that the outsole is in contact with the ground plane (i.e., as if worn by a user standing in an upright manner on stable, level earth).

The following clauses detail additional embodiments and features of the presently described technology and should be read in light of the drawings where applicable. Each clause should be viewed as a non-limiting embodiment of the presently described design.

Clause 1. An article of footwear comprising: an upper having an internal volume adapted to receive a foot of a wearer; a sole structure secured to the upper, the sole structure including: a chassis plate provided within the upper; a midsole removably secured to the chassis plate via plurality of fasteners extending therebetween, the midsole positioned such that a portion of the upper extends between the chassis plate and the midsole; and an outsole tread element removably attached to a ground facing surface of the midsole.

Clause 2. The article of footwear of clause 1, wherein the plurality of fasteners comprise a plurality of threaded fasteners extending between and removably securing the midsole with the chassis plate.

Clause 3. The article of footwear of clause 1, wherein: the chassis plate comprises a plurality of threaded anchors; the midsole comprises a plurality of apertures, each aperture corresponding to a different one of the plurality of threaded anchors; and wherein the plurality of fasteners comprise a plurality of threaded bolts, each threaded bolt extending through a corresponding one of the plurality of apertures and being threadably engaged with a different one of the plurality of threaded anchors to secure the midsole with the chassis plate.

Clause 4. The article of footwear of clause 3, wherein the midsole comprises a mechanical cushioning structure having an upper plate coupled with a lower plate, the upper plate including the plurality of apertures through which the plurality of threaded fasteners extend, the lower plate comprising an anterior end portion, a posterior end portion, and a central portion disposed between the anterior end portion and the posterior end portion; and wherein: the central portion of the lower plate is spaced apart from the upper plate; at least one of the anterior end portion or the posterior end portion of the lower plate is secured to the upper plate; and the outsole tread element is secured to the lower plate.

Clause 5. The article of footwear of clause 4, wherein the lower plate comprises a plurality of apertures, wherein the plurality of apertures in the lower plate are aligned with the plurality of apertures in the upper plate such that each of the threaded fasteners may be tightened using an elongate tool passing through a respective one of the plurality of apertures in the lower plate.

Clause 6. The article of footwear of clause 5, wherein the outsole tread element includes a plurality of posts extending into the plurality of apertures in the lower plate; and wherein the elongate tool is capable of extending through an aperture of the plurality of apertures in the lower plate only when the post of the outsole treat element is removed from the aperture.

Clause 7. The article of footwear of clause 6, wherein each of the plurality of posts extend through the lower plate, and further include a retention feature disposed on an opposite side of the lower plate from the ground facing surface.

Clause 8. The article of footwear of clause 5, wherein the outsole tread element comprises a plurality of discrete outsole elements, and wherein each of the plurality of discrete outsole elements at least partially extends into a different one of the plurality of apertures in the lower plate.

Clause 9. The article of footwear of clause 4, wherein the sole structure includes a forefoot region, a midfoot region, and a heel region, and wherein the lower plate is a first lower plate and is provided in the heel region; wherein the mechanical cushioning structure further comprises a second lower plate provided in the forefoot region, the second lower plate comprising an anterior end portion, a posterior end portion, and a central portion disposed between the anterior end portion and the posterior end portion; and wherein: the central portion of the second lower plate is spaced apart from the upper plate; and at least one of the anterior end portion or the posterior end portion of the second lower plate is secured to the upper plate.

Clause 10. The article of footwear of clause 9, wherein the anterior end portion of the first lower plate is joined to the upper plate at a first location, the posterior end portion of the second lower plate is joined to the upper plate at a second location, and wherein the first location is anterior to the second location.

Clause 11. The article of footwear of clause 9, wherein the anterior end portion and the posterior end portion of the first lower plate both extend into contact with and are both secured to the upper plate; and wherein the anterior end portion and the posterior end portion of the second lower plate both extend into contact with and are both secured to the upper plate.

Clause 12. The article of footwear of clause 9, wherein the upper plate, first lower plate, and second lower plate are each formed from a common polymer and wherein each of the first lower plate and second lower plate integrally extend from the upper plate.

Clause 13. The article of footwear of clause 9, wherein the first lower plate comprises a first plurality of apertures, wherein the first plurality of apertures in the first lower plate are aligned with a first subset of the plurality of apertures in the upper plate such that each of the threaded fasteners extending through the first subset of the plurality of apertures in the upper plate may be tightened using a tool passing through a respective one of the first plurality of apertures in the first lower plate; and wherein the second lower plate comprises a second plurality of apertures, wherein the second plurality of apertures in the second lower plate are aligned with a second subset of the plurality of apertures in the upper plate such that each of the threaded fasteners extending through the second subset of the plurality of apertures in the upper plate may be tightened using a tool passing through a respective one of the second plurality of apertures in the second lower plate.

Clause 14. The article of footwear of clause 9, wherein the midsole further comprises: a lateral side and a medial side; a void extending through the midsole from the lateral side to the medial side; and wherein the void further extends between the central portion of first lower plate and the upper plate.

Clause 15. The article of footwear of clause 14, wherein the void is a first void; and wherein the midsole further comprises a second void extending through the midsole from the lateral side to the medial side, the second void further between the central portion of second lower plate and the upper plate.

Clause 16. The article of footwear of clause 9, wherein the midsole comprises a first radiused transition provided at a posterior end of the midsole and a second radiused transition provided at an anterior end of the midsole; and wherein the first lower plate is secured to the upper plate via the first radiused transition, and wherein the second lower plate is secured to the upper plate via the second radiused transition.

Clause 17. The article of footwear of clause 16, wherein the first lower plate, the first radiused transition and the upper plate are integrally formed, and wherein the second lower plate, the second radiused transition and the upper plate are all integrally formed.

Clause 18. The article of footwear of clause 1, wherein the upper is formed from a knit material that comprises a thermoplastic polymer, and the midsole is entirely formed from a thermoplastic polymer.

Clause 19. The article of footwear of clause 1, wherein the midsole is formed via an additive manufacturing process.

The invention claimed is:

1. An article of footwear comprising:

an upper having an internal volume adapted to receive a foot of a wearer;

a sole structure secured to the upper, the sole structure including:

a chassis plate provided within the upper the chassis plate comprising a plurality of threaded anchors;

a midsole removably secured to the chassis plate via plurality of threaded bolts extending therebetween, each threaded bolt of the plurality of threaded bolts extending through a corresponding aperture in the midsole and being threadably engaged with a different one of the plurality of threaded anchors, the midsole positioned such that a portion of the upper extends between the chassis plate and the midsole; and the midsole further comprising:

a mechanical cushioning structure having an upper plate coupled with a lower plate, the upper plate including the plurality of apertures through which the plurality of threaded fasteners extend, the lower plate comprising an anterior end portion, a posterior end portion, and a central portion disposed between the anterior end portion and the posterior end portion;

wherein:

the central portion of the lower plate is spaced apart from the upper plate;

at least one of the anterior end portion or the posterior end portion of the lower plate is secured to the upper plate; and an outsole tread element is removably secured to a ground facing surface the lower plate.

2. The article of footwear of claim 1, wherein the plurality of fasteners comprise a plurality of threaded fasteners extending between and removably securing the midsole with the chassis plate.

3. The article of footwear of claim 1, wherein the lower plate comprises a plurality of apertures, wherein the plurality of apertures in the lower plate are aligned with the plurality of apertures in the upper plate such that each of the threaded fasteners may be tightened using an elongate tool passing through a respective one of the plurality of apertures in the lower plate.

4. The article of footwear of claim 3, wherein the outsole tread element includes a plurality of posts extending into the plurality of apertures in the lower plate; and wherein the elongate tool is capable of extending through an aperture of the plurality of apertures in the lower plate only when the post of the outsole treat element is removed from the aperture.

5. The article of footwear of claim 4, wherein each of the plurality of posts extend through the lower plate, and further include a retention feature disposed on an opposite side of the lower plate from the ground facing surface.

6. The article of footwear of claim 3, wherein the outsole tread element comprises a plurality of discrete outsole elements, and wherein each of the plurality of discrete outsole elements at least partially extends into a different one of the plurality of apertures in the lower plate.

7. The article of footwear of claim 1, wherein the sole structure includes a forefoot region, a midfoot region, and a heel region, and wherein the lower plate is a first lower plate and is provided in the heel region;

wherein the mechanical cushioning structure further comprises a second lower plate provided in the forefoot region, the second lower plate comprising an anterior end portion, a posterior end portion, and a central portion disposed between the anterior end portion and the posterior end portion; and wherein:

the central portion of the second lower plate is spaced apart from the upper plate; and at least one of the anterior end portion or the posterior end portion of the second lower plate is secured to the upper plate.

8. The article of footwear of claim 7, wherein the anterior end portion of the first lower plate is joined to the upper plate at a first location, the posterior end portion of the second lower plate is joined to the upper plate at a second location, and wherein the first location is anterior to the second location.

9. The article of footwear of claim 7, wherein the anterior end portion and the posterior end portion of the first lower plate both extend into contact with and are both secured to the upper plate; and wherein the anterior end portion and the posterior end portion of the second lower plate both extend into contact with and are both secured to the upper plate.

10. The article of footwear of claim 7, wherein the upper plate, first lower plate, and second lower plate are each formed from a common polymer and wherein each of the first lower plate and second lower plate integrally extend from the upper plate.

11. The article of footwear of claim 7, wherein the first lower plate comprises a first plurality of apertures, wherein the first plurality of apertures in the first lower plate are aligned with a first subset of the plurality of apertures in the upper plate such that each of the threaded fasteners extending through the first subset of the plurality of apertures in the upper plate may be tightened using a tool passing through a respective one of the first plurality of apertures in the first lower plate; and wherein the second lower plate comprises a second plurality of apertures, wherein the second plurality of apertures in the second lower plate are aligned with a second subset of the plurality of apertures in the upper plate such that each of the threaded fasteners extending through the second subset of the plurality of apertures in the upper plate may be tightened using a tool passing through a respective one of the second plurality of apertures in the second lower plate.

12. The article of footwear of claim 7, wherein the midsole further comprises:

a lateral side and a medial side;

a void extending through the midsole from the lateral side to the medial side; and wherein the void further extends between the central portion of first lower plate and the upper plate.

13. The article of footwear of claim 12, wherein the void is a first void; and wherein the midsole further comprises a second void extending through the midsole from the lateral side to the medial side, the second void further between the central portion of second lower plate and the upper plate.

14. The article of footwear of claim 7, wherein the midsole comprises a first radiused transition provided at a posterior end of the midsole and a second radiused transition provided at an anterior end of the midsole; and wherein the first lower plate is secured to the upper plate via the first radiused transition, and wherein the second lower plate is secured to the upper plate via the second radiused transition.

15. The article of footwear of claim 14, wherein the first lower plate, the first radiused transition and the upper plate are integrally formed, and wherein the second lower plate, the second radiused transition and the upper plate are all integrally formed.

16. The article of footwear of claim 1, wherein the upper is formed from a knit material that comprises a thermoplastic polymer, and the midsole is entirely formed from a thermoplastic polymer.

17. The article of footwear of claim 1, wherein the midsole is formed via an additive manufacturing process.

* * * * *